United States Patent [19]

Fennell

[11] 4,118,762

[45] Oct. 3, 1978

[54] ORNAMENTAL LIGHT ARRANGEMENT

[76] Inventor: John C. Fennell, Rte. 4, Harmon Dr., Swainsboro, Ga. 30401

[21] Appl. No.: 673,648

[22] Filed: Apr. 5, 1976

[51] Int. Cl.[2] ..... F21V 3/00; F21V 5/00

[52] U.S. Cl. ..... 362/311

[58] Field of Search ..... 240/10 T, 2 G, 10 R, 240/10 A, 10 B, 10 C, 10 P, 10 S, 10 Q, 10 D, 10 F, 100, 128, 153, 52.2, 103 C; 362/121, 122, 226, 257, 311

[56] References Cited

U.S. PATENT DOCUMENTS

| | | | |
|---|---|---|---|
| 2,059,653 | 11/1936 | Pretzfelder | 240/10 T |
| 2,114,194 | 4/1938 | Sadacca | 240/100 X |
| 2,339,385 | 1/1944 | Dupler | 240/100 X |
| 2,817,007 | 12/1957 | Gallagher | 240/52.2 X |
| 3,727,043 | 4/1973 | Wall | 240/10 T |
| 3,727,044 | 4/1973 | Monroy | 240/10 R |
| 3,731,081 | 5/1973 | Yellin | 240/10 R |

FOREIGN PATENT DOCUMENTS

| | | | |
|---|---|---|---|
| 986,606 | 3/1965 | United Kingdom | 240/10 T |

*Primary Examiner*—John Gonzales

[57] ABSTRACT

An ornamental light arrangement is provided wherein a base has a light socket in an end thereof and electrical conductors connected to said light socket at an opposite end thereof. A small light bulb is receivable in said socket to provide illumination, and a decorative globe is received around said base and removably secureable thereat, whereby the globe is illuminated by the light bulb in the socket. The base has a forward taper in the direction of the socket to receive the globe therearound for removable securement thereto by a friction fit, a spring override, O rings or the like.

5 Claims, 8 Drawing Figures

ORNAMENTAL LIGHT ARRANGEMENT

BACKGROUND OF THE INVENTION

Decorative lighting, especially Christmas tree lights and the like, has historically embodied a plurality of electrical bases connected along a electrically conductive line with light bulb sockets located in the bases. Principally, a plurality of colored lights have been utilized in these ornamental ligthing arrangements, which are replaced once the lights burn out. In certain arrangements, very ornate, decorative bulbs have been produced by glass blowing techniques, decorative surface designs and the like. These ornate bulbs are quite expensive. Due to a short light life and danger of breakage, the truly ornate bulbs are generally not feasible from an economical standpoint, and their use is generally limited to a small number, per installation.

The present invention affords an improvement over the prior art, in that, a simple light bulb arrangement may be utilized for Christmas lights and other decorative light arrangements where an expensive decorative globe may be removeably secured around a simple light bulb to better decorate the home, Christmas tree or the like as desired. According to the present invention, however, a substantial amount of money may be paid for the decorative globe since the globe is not directly associated with the light bulb, but instead is merely received around same. A transparent, translucent or opaque globe body receives illumination from the light bulb located within same and affords an improved, economical and decorative situation. As opposed to arrangements of the prior art where the decorative light bulbs per se, were employed, a light bulb of the present invention that burns out may simply be replaced without loss of the decorative globe. Thereafter, a new bulb is inserted and the globe may be continuously reused over an extended period of time.

SUMMARY OF THE INVENTION

It is an object of the present invention to provide an improved ornamental lighting arrangement.

Another object of the present invention is to provide an improved ornamental light arrangement having a removeable decorative globe thereon.

Still another object of the present invention is to provide an improved arrangement for a string of Christmas lights where decorative globes are utilized, removeably separate from light bulbs employed therewith.

Generally speaking, the present invention relates to an ornamental lighting arrangement comprising a light receiving element, said element having a base, said base receiving a socket in one end thereof to receive a light bulb therein, said base also receiving an electrical conductor for said socket, said base having a forward taper in the direction of said light socket; and a globe receivable over a light bulb received in said socket, said globe having an opening therein that is receivable over at least a portion of said base for removeable securement thereto adjacent the socket receiving end thereof.

More specifically, the arrangement of the present invention utilizes a light receiving base that has an outside taper opposite that of conventional Christmas lights, in that, a forward taper is provided on the exterior surface of same in the direction of an end of the base that receives a light socket therein. The light socket extends into the base and preferably has electrically connected thereto, one or more electrical conductors through which electricity may flow to illuminate a light bulb received in the socket. In a most preferred arrangement, a plurality of such units are spaced along the length of the electrical conductors to provide a string of lights for Christmas tree or other decorative use.

In conjunction with the forward taper of the exterior of the base, the decorative globe that is receivable around said base, has an opening therein that passes over at least a portion of the tapered base surface, with the opening having a bearing surface area therein. As such, the bearing surface may mate with the outer forward tapered surface of the base in frictional engagement to hold the globe thereon. Additionally, however, securement means may be provided on the base to permit the passage of the appropriate portion of the globe therearound, after which the securement means precludes inadvertent disassociation of the globe from the base. Such securement means includes a plurality of protrusions that are resilient, or are designed such that resilience of the globe wall will permit passage of the globe opening over the protrusions in the direction of the rear end of the base, after which, without additional force, the globe will not become disassociated from the base.

In another embodiment of the present invention, an annular member such as an O ring may be received around the forward tapered surface of the base and is receivable in a groove provided internally of the bearing surface of the globe to unite the globe to the base. Further, a plurality of spring elements may be secured longitudinally along the forward taper of the base while the globe is provided with an inwardly protruding lip surrounding the globe opening which deforms the spring elements during passage of the lip thereby, after which the springs return to their original configuration and impede removal of the globe, making contact with the inwardly protruding lip.

In still another embodiment of the present invention, securement means such as a suction cup or the like may be provided on the globe to permit securement of the globe to a surface such as a mantlepiece or the like.

DESCRIPTION OF THE PREFERRED EMBODIMENTS

Figure 1:
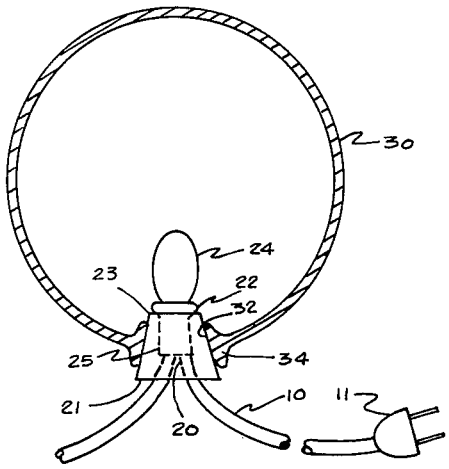
FIG. 1 is a side view of a lighting arrangement according to the present invention partially in cross section.
Figure 7:
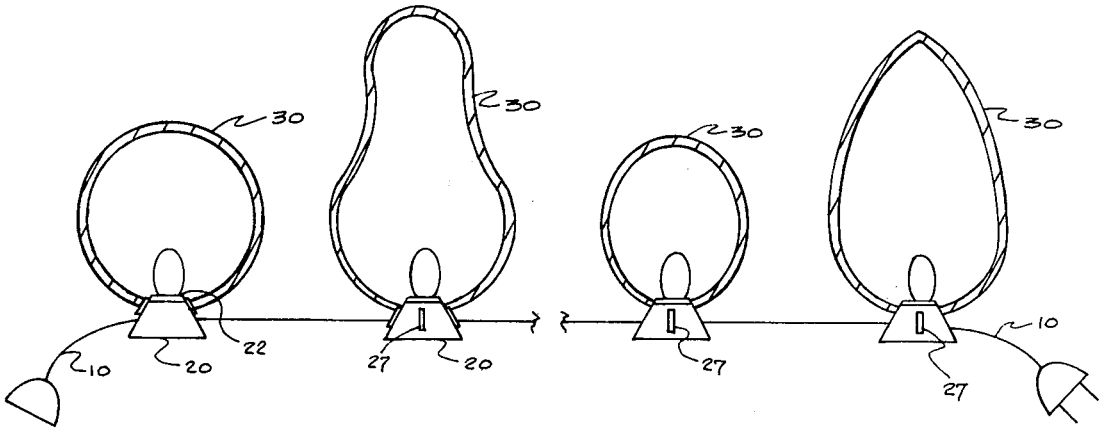
FIG. 7 is a side view of a string of lights embodying the present invention.

Making reference to the Figures, preferred embodiments of the present invention will now be described in detail. In FIG. 1, a single light element is illustrated that may represent one of a number of lights that are spaced apart on an electrical conductor 10, to form a string of lights as depicted in FIG. 7. The light arrangement includes a base 20 in which a light socket 22 is received in a forward end thereof. Light socket 22 as shown partially in phantom in FIG. 1 is connected to an electrical conductor 10 and has a light bulb 24 received therein. Once electrical plug 11 of conductor 10 is inserted into a proper electrical receptacle, and electricity is supplied thereto, illumination will result at each of the sockets 22 along conductor 10 as are operational and have an operational bulb 24 therein. Certainly, different types of strings of lights are produced where the adjacent lights are in series whereby a malfunction of one light will preclude operation of the rest of the lights. In some light string systems, each light functions independently of the others. The type electrical system for applying power to the particular sockets, does not form a part of the present invention and any suitable arrangement may be employed for one or more of the present light units. Moreover, only a single light unit is particularly illustrated herein, though certainly the units may be utilized individually, or along a continuous length of electrical conductor 10 as shown in FIG. 7. As may be seen in FIG. 1, a rear end 21 of base 20 is larger than a forward end 23 adjacent light socket 22. In between, there is a forward taper of the outer surface of base 20 in the direction of forward end 23, the purpose of which will become evident hereinafter.

A decorative globe 30 is received around light base 20 at a globe opening 32 where an enlarged flange 34 makes frictional engagement with base 20 along the tapered surface 25 to removeably secure globe 30 thereat. In this fashion, an expensive, ornate and decorative globe 30 may be employed, which will not be lost when light bulb 24 burns out. Instead, one would simply be required to remove globe 30, change an inexpensive bulb 24 for a new inexpensive bulb 24 and thereafter replace globe 30 thereover. According to this arrangement, an efficient and economical decorative lighting system is available.

Figure 2:
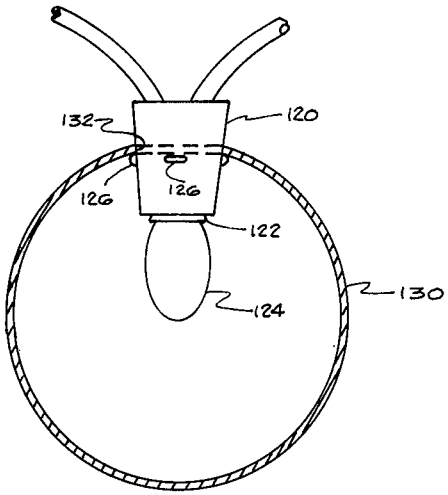
FIG. 2 is a side view of a further embodiment of the present invention partially in cross section.

FIG. 2 illustrates another securement embodiment for removeably securing a globe 130 onto a base 120 having a light socket 122 and light bulb 124 therein. Base 120 is provided with a plurality of projections or protuberances 126 that permit an opening 132 in globe 130 to be forced thereover. Once protuberances 126 are inside globe 130, separation of globe 130 from base 120 in the absence of a force will be precluded thereby. Protuberances 126 may be resilient in nature such that they are slightly deformed to permit passage through the globe opening 132, or may be of a sufficient dimension with respect to the size of opening 132 that the flexibility of the material from which globe 130 is manufactured will permit expansion of globe 130 under slight pressure sufficient to permit protuberances 126 to pass through opening 132.

Figure 3:
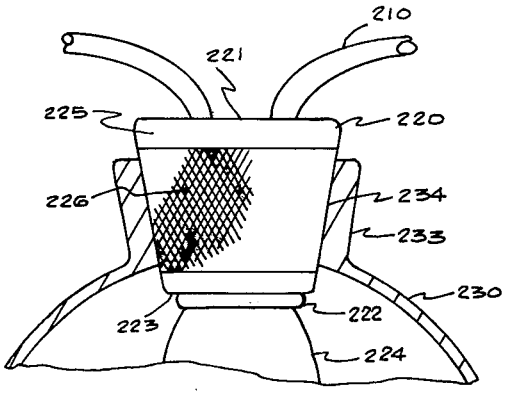
FIG. 3 is a side view of a portion of the lighting arrangement to the present invention showing a portion of the globe in cross section to illustrate a further embodiment.

In FIG. 3, a further embodiment of the present invention is illustrated wherein a globe 230 is provided with a tubular section 233 extending outwardly therefrom. A light base 220 having a light socket 222 received therein is provided along a suitable electrical conductor 210 and receives globe extension 233. Light base 220 has a forward tapered surface 225 from a rear end 221 to forward end 223, a portion of which is knurled or the like at area 226. Knurled surface 226 mates with an inner surface 234 of extension 233 of globe 230 to provide a suitable removeable securement between globe 230 and base 220 and thus hold globe 230 onto light base 220, until sufficient force is applied to overcome the resistance between inner extension surface 234 and knurled base surface 226.

Figure 4:
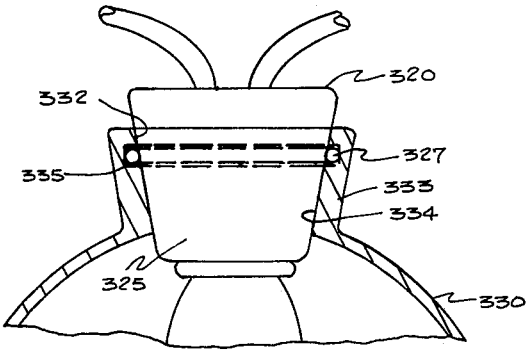
FIG. 4 is a further partial side view showing the globe in cross section to illustrate yet another embodiment.

A light base 330 is illustrated in FIG. 4 provided with an annular member 327 that is received around base 320 at some point along the forward tapered surface 325 of same. A globe 330 is provided having a tubular extension 333 extending outwardly therefrom with an opening 332 therethrough. Located along an inside wall 334 of tubular extension 333 is a recess 335. Annular member 327 located around base 320 is resilient in nature and is deformed upon placement of globe 330 around base 320 until annular member 327 falls into groove 335 within globe extension 333. At this point, annular member 327 returns to its original condition and cooperates with recess or groove 335 to hold globe 330 on light base 320.

Figure 5:
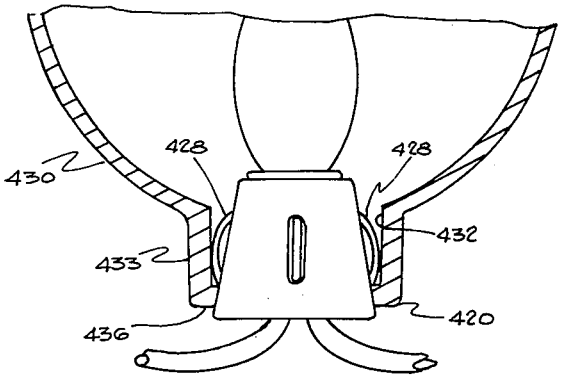
FIG. 5 is a further side view of the lighting arrangement of the present invention illustrating another embodiment with the globe in cross section.

FIG. 5 shows yet another embodiment of the present invention wherein a globe 430 is received around a light base 420. Globe 430 has a tubular extension 433 that defines an opening 432 therein. At an outer end of tubular member 433 is an inwardly projecting lip 436 that extends around same. Light base 420 is provided around its periphery and along forward tapered surface 425 with a plurality of spring elements 428 that are secured to base 420 in such fashion as to create an arcuate appearance of each spring. As globe 430 is fitted onto base 420, lip 436 extending inwardly around tubular element 433 engages spring elements 428 and deforms same until lip 436 has passed thereover. Thereafter, the dimensions of opening 432 permit springs 428 to resume a normal configuration whereby globe 430 is held on base 420 until sufficient force is applied to again depress or deform springs 428 and permit passage of lip 436 thereover.

Figure 6:
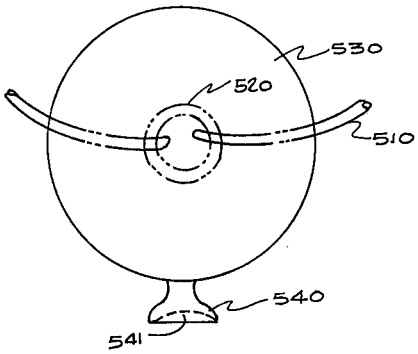
FIG. 6 is a bottom view of a lighting arrangement according to the present invention illustrating a securement means for the globe.

In FIG. 6, a globe 530 is illustrated with electrical conductors 510 and a light base 520 being shown in phantom in conjunction therewith. Secured to one side of globe 530 is a globe securement means 540 that is provided to permit globe 530 to be attached to some further surface. As illustrated in FIG. 6, a suction cup is preferred, which would be cemented or otherwise affixed to globe 530 and extend outwardly therefrom, having a recessed area 541 provided therein from which air is expelled in producing a partial vacuum for securement of globe 530 to the intended surface such as a mantlepiece, window pane or the like.

A partial string of lights is illustrated in FIG. 7, where a plurality of light bases 20 are located along an electrical conductor 10. Each light base 10 has a light socket received therein which in turn, receives a small light bulb 24. A globe 30 of a particular configuration and ornamentation is received over light bulb 24 and is removeably secured around a portion of base 20. Each base 20 may be further provided with a clip or the like 27 for securement of the particular base 20 to a portion of a Christmas tree.

Figure 8:
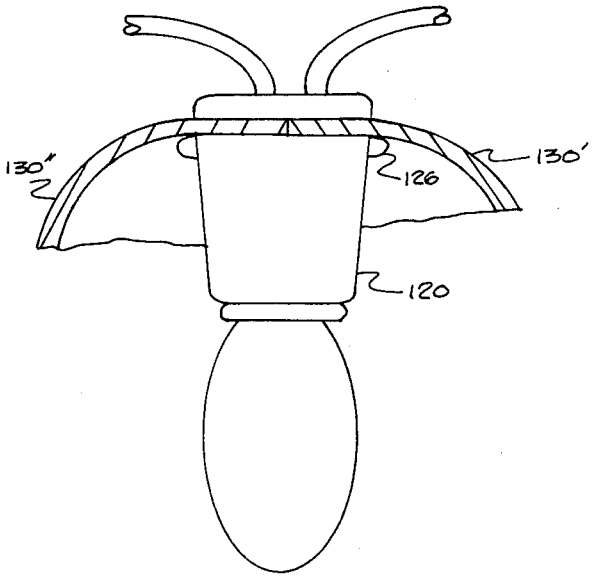
FIG. 8 is a partial side view of a further embodiment of the present invention.

As illustrated in FIG. 8, the globe 130 could be fabricated from a plurality of mating ports 130' and 130'' which would snap together at their juncture by any suitable means. With such an arrangement, base 120 could be straight along its length and projections 126 could be rigid with globe sections 130' and 130'' being snapped together around projections 126 to secure globe 130 to base 120.

Decorative globes suitable for use according to the present invention are not limited in any fashion as to materials of construction, size, shape, color or the like so long as the particular globe being employed may be removeably secureable around a light base as discussed herein. For example, the globe may take the form of an animal or human figure, a house, a snowball, a Christmas tree, or any other conceivable shape. Likewise, the materials may be glass, plastic, paper or the like so long as the requisite qualities as described herein are met. Insofar as the particular globe is concerned, the aesthetics of same may be very substantial, depending upon whether the side walls of the globe are transparent, translucent or opaque, and in such situations, the combination of one or more of the three may be included.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An ornamental light arrangement comprising:

(a) a light receiving element, said element having a base, said base receiving a light socket in one end thereof to hold a light bulb therein, said base also having an electrical conductor, said conductor being electrically connected to said socket, said base having a forward surface taper in the direction of said light socket and having at least one spring member secured thereto along said forward tapered surface; and (b) a globe receivable over a light bulb located in said socket, said globe having an opening therein with an inwardly protruding lip therearound that is receivable over at least a portion of said forward tapered surfaces and deforms said at least one spring member during placement thereover with said spring member returning to its original configuration inside said globe to secure said globe to said base.

2. An ornamental light arrangement as defined in claim 1 wherein the globe has a decorative indicia thereon.

3. An ornamental light arrangement as defined in claim 1 wherein said globe has securement means thereon to attach same to a surface.

4. An ornamental light arrangement as defined in claim 3 wherein said securement means is a suction cup.

5. An ornamental light arrangement as defined in claim 1 wherein a plurality of said light receiving elements and globes are located along an electrical conductor.

* * * * *